US007573246B2

(12) United States Patent
Lin et al.

(10) Patent No.: US 7,573,246 B2
(45) Date of Patent: Aug. 11, 2009

(54) LOW DROP-OUT LINEAR REGULATOR INCLUDING A STABLE COMPENSATION METHOD AND CIRCUIT FOR PARTICULAR USE IN AUTOMOTIVE APPLICATIONS

(75) Inventors: DaSong Lin, ShenZhen (CN); Gang Zha, ShenZhen (CN)

(73) Assignee: Shenzhen STS Microelectronics Co., Ltd. (CN)

( * ) Notice: Subject to any disclaimer, the term of this patent is extended or adjusted under 35 U.S.C. 154(b) by 235 days.

(21) Appl. No.: 11/684,434

(22) Filed: Mar. 9, 2007

(65) Prior Publication Data

US 2007/0216382 A1 Sep. 20, 2007

(30) Foreign Application Priority Data

Mar. 17, 2006 (CN) ..... 2006 1 0074740

(51) Int. Cl.
*G05F 1/575* (2006.01)
*G05F 3/26* (2006.01)

(52) U.S. Cl. ..... 323/273; 323/315

(58) Field of Classification Search ..... 323/273, 323/274, 275, 277, 279, 280, 281, 315, 316
See application file for complete search history.

(56) References Cited

U.S. PATENT DOCUMENTS 5,945,818 A * 8/1999 Edwards ..... 323/273
6,420,857 B2 * 7/2002 Fukui ..... 323/280
7,106,042 B1 * 9/2006 Jackson ..... 323/316
7,218,082 B2 * 5/2007 Walter et al. ..... 323/273
7,294,994 B2 * 11/2007 Ryu et al. ..... 323/282

* cited by examiner

*Primary Examiner*—Gary L Laxton
(74) *Attorney, Agent, or Firm*—Lisa K. Jorgenson; William J. Mubida

(57) ABSTRACT

A compensated regulator includes a transconductance stage having a positive input for receiving a reference voltage, a negative input, and an output, an adjustable compensation block coupled between the output of the transconductance stage and ground, a feedback circuit having a first node coupled to the output of the compensated regulator, a second node coupled to the negative input of the transconductance stage, and a third node coupled to ground, and a driver stage having an input coupled to the output of the transconductance stage, a current output coupled to the output of the compensated regulator, and a sense output coupled to the adjustable compensation block.

10 Claims, 8 Drawing Sheets

LOW DROP-OUT LINEAR REGULATOR INCLUDING A STABLE COMPENSATION METHOD AND CIRCUIT FOR PARTICULAR USE IN AUTOMOTIVE APPLICATIONS

RELATED APPLICATION

The present application claims priority of Chinese Application No. 200610074740.5 filed Mar. 17, 2006, which is incorporated herein in its entirety by this reference.

BACKGROUND OF THE INVENTION

The present invention is related to linear regulator circuits, and, more particularly, to a linear regulator circuit having a stable compensation circuit and method that is particularly useful when used in automotive applications.

A traditional regulator integrated circuit 100 for use in automotive applications is shown in FIG. 1. In a typical example, transistors M1 and M2 are 5V NMOS devices, transistors M4 and M5 are HV-NDMOS devices, and transistors M3 and M6 are HV-PMOS devices. Transistors Q1 and Q2 are bipolar transistors. An external 14.4V battery voltage is applied at node 102, an internal 5V battery voltage is applied at node 104, and a bandgap voltage VBG is applied at node 106. An operational amplifier or gm stage 108 is used in the feedback loop. The output of the regulator 100 drives the output load as shown.

In the regulator loop of the circuit shown in FIG. 1, there are three poles and two zeros that are the main contribution to stability as listed below:

P0=Req3*Co; P1=Req1*Cc; P2=Req2*Ceq;

Z0=ESR*Co; Z1=Rc*Cc.

where:

Co: Output capacitor,

Cc: Internal compensation capacitor,

Ceq: equivalent capacitor in the gate node of M6,

ESR: equivalent series resistor of Co,

Req1: output resistor of gm stage,

Req2: equivalent resistor in the gate node of M6, and

Req3: equivalent resistor in the output node of the regulator.

The problem with the low drop-out regulator 100 shown in FIG. 1 is that a different load current results in different Idr1 and Idr2 currents. Equivalent resistors Req2 and Req3 are also different for different load currents, and hence poles P0 and P2 are undesirably variable.

In a practical design, zero Z1 is constant and used to cancel pole P2. Poles P0 and P1 are dominant poles, but P1 is constant while P0 is variable. Therefore, if Z1=P2 are under light load conditions, then regulator 100 tends to over-compensate under heavy load conditions. This is because poles P2 and P0 are much farther out in frequency in heavy load conditions than in light load conditions, while Z1 is quite low in frequency. If Z1=P2 under heavy load conditions, then regulator 100 tends to under-compensate under light load conditions, because poles P2 and P0 are much lower in frequency in light load than in heavy load while Z1 is quite high. And so a stable regulator requires that the capacitance and ESR of the output capacitor should be in a very limited range to avoid worsening over-compensation or under-compensation any further.

What is desired, therefore, is a low drop-out regulator that can be easily compensated without any of the drawbacks such as load current sensitivity and the requirement of a limited output capacitance range that is present in prior art regulators.

SUMMARY OF THE INVENTION

A compensated regulator for use in automotive and other applications includes a transconductance stage having a positive input for receiving a reference voltage, a negative input, and an output, an adjustable compensation block coupled between the output of the transconductance stage and ground, a feedback circuit having a first node coupled to the output of the compensated regulator, a second node coupled to the negative input of the transconductance stage, and a third node coupled to ground, and a driver stage having an input coupled to the output of the transconductance stage, a current output coupled to the output of the compensated regulator, and a sense output coupled to the adjustable compensation block.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

DETAILED DESCRIPTION

Figure 1:
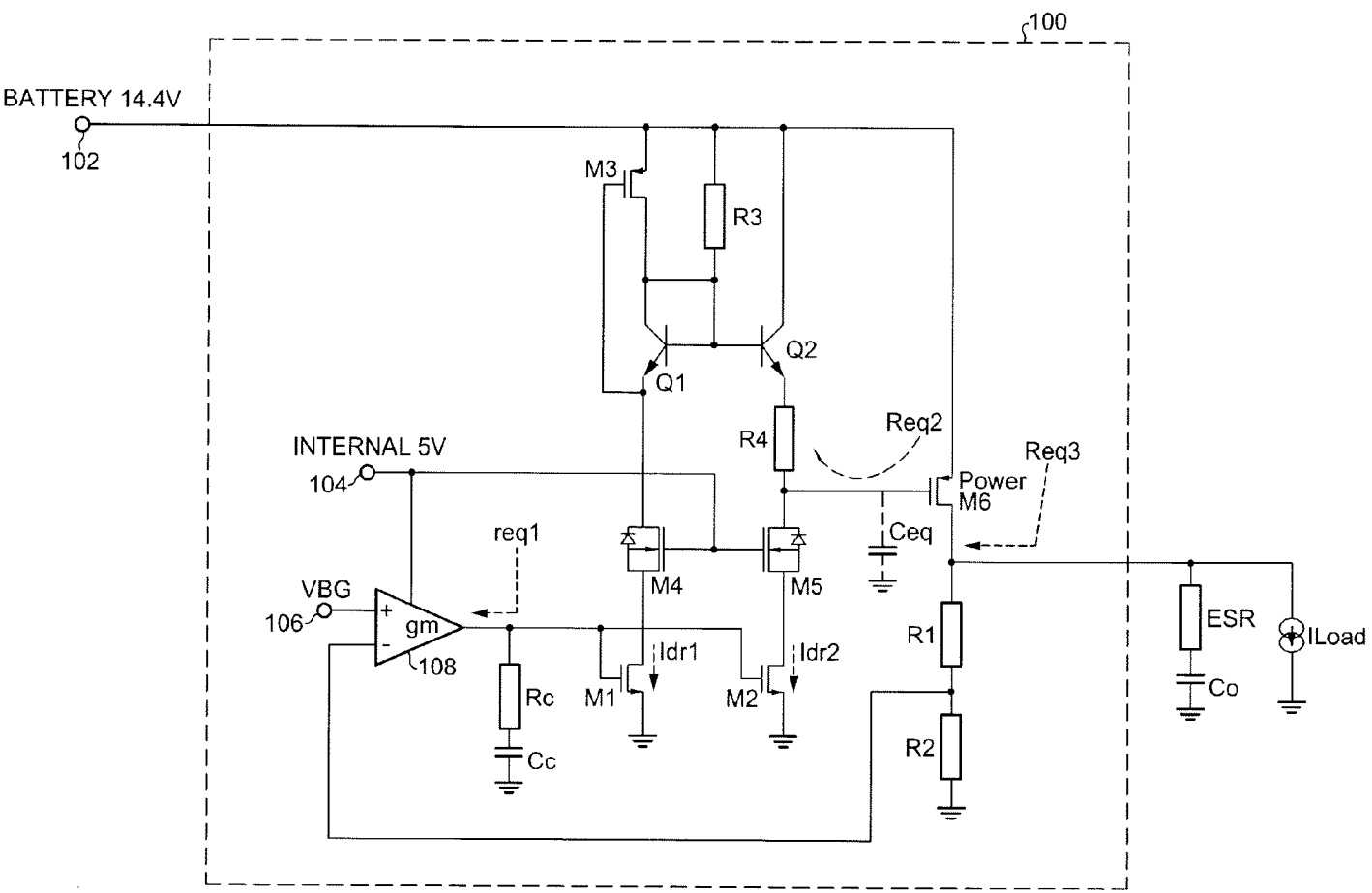
Fig. 1 Prior Art
FIG. 1 is a schematic diagram of a traditional regulator used in automotive applications, according to the prior art.
Figure 2:
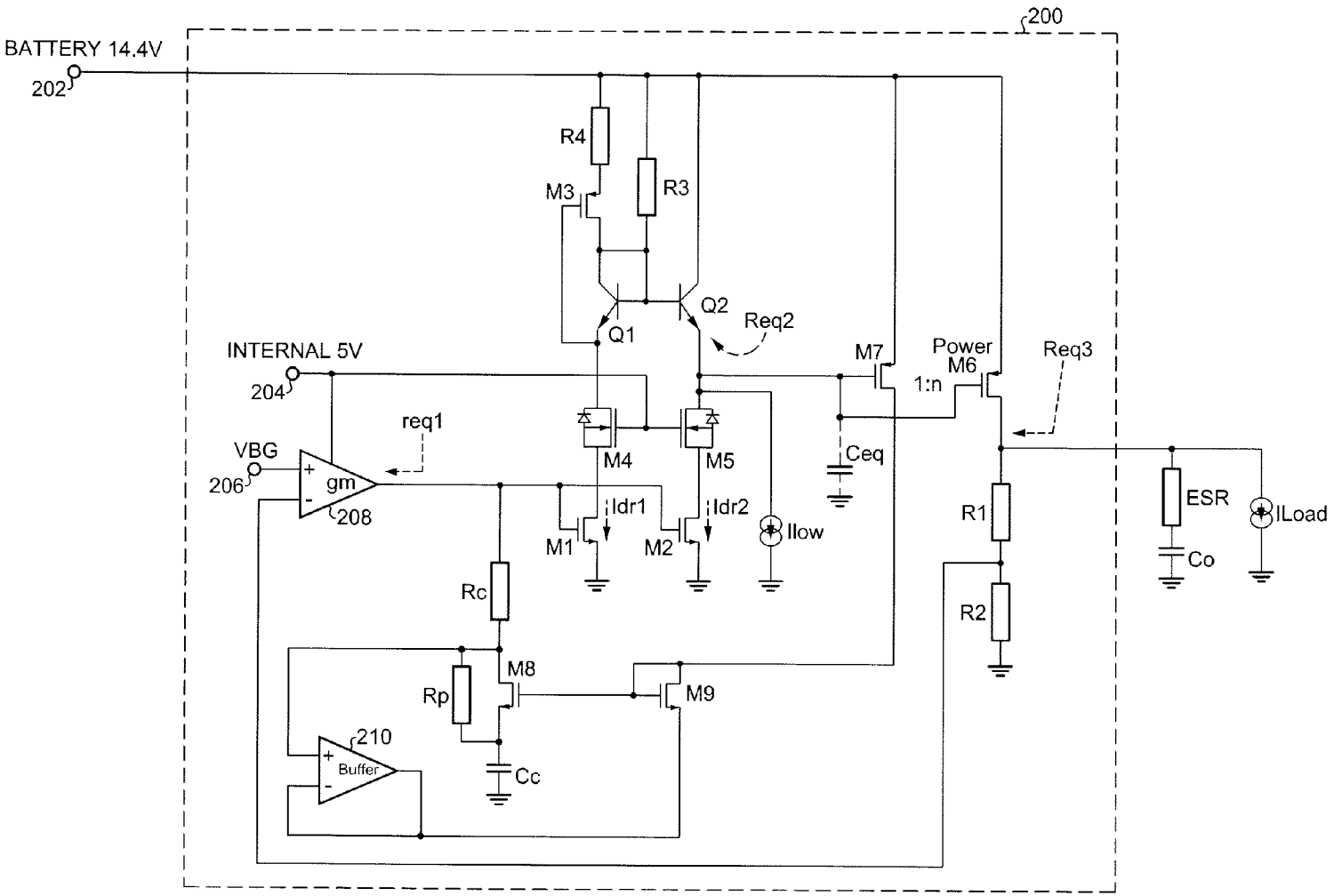
FIG. 2 is a schematic diagram of a regulator using the compensation circuit and method according to the present invention.

According to the present invention, the compensation method and circuit 200 shown in FIG. 2 forces zero Z1 and pole P2 to have substantially the same dependence on the load current (Iload).

Referring to FIG. 2, internal zero Z1 is defined by:

$$Z1=Rzero\times Cc=(Rc+(Rp\|R_{onM8}))\times Cc \quad (1)$$

Transistors M6 and M7 have an area ratio of n:1, and transistors M8 and M9 have an area ratio of 1:1. In a low quiescent current (Iq) regulator, resistors R1 and R2 are very large and therefore $I_{ds_M6}\approx$Iload. Buffer 210 is used to force $V_{gs_M8}=V_{gs_M9}$. Transistor M8 generally operates in the triode region and transistor M9 generally operates in the saturation region, hence:

$$R_{onM8} = \frac{1}{g_{m9}} = \frac{1}{\sqrt{2k_{m8} \times \frac{Iload}{n}}} \quad (2)$$

Under heavy load conditions, $R_{onM8}$ is of the kohm order, but under light load conditions, $R_{onM8}$ is of the 10 Mohm order. In order to let the compensation resistor of the internal zero have a smoother transition from light load to heavy load conditions, resistors Rc and Rp are used. Resistor Rc is of the 10 kohm order, and resistor Rp is of the 100 kohm order. From light load conditions to heavy load conditions, therefore, the compensation resistor of the internal zero changes from the 100 kohm order to the 10 kohm order and change with the square root of the load current (Iload). Capacitor Cc is of the 10 pf order and does not change substantially with operating conditions. Therefore, zero Z1 also changes with the square root of the load current (ILoad).

From FIG. 2, pole P2 can also be determined:

$$P2 = Req2 \times Ceq \quad (3)$$

Capacitor Ceq is the equivalent total capacitance on the gate node of power transistor M6, which mainly comes from the gate capacitance of transistor M6 and does not change with operating conditions. Assuming the area ratio of transistors M1 and M2 is 1:1, then Idr1=Idr2=Idr. Resistor R4 is of the kohm order, and resistor R3 is of the 100 kohm order. Resistor R3 is quite large and can be ignored to facilitate calculation and so:

$$Req2 = \frac{Vt}{Ilow + Idr} + \frac{R4 + R_{onM3}}{\beta_{npn}} = \frac{Vt}{Ilow + Idr} + \frac{1}{\beta_{npn} \times \sqrt{2k_{M3} \times Idr}} + \frac{R4}{\beta_{npn}} \quad (4)$$

$$Idr \times R4 + V_{gsM3} = V_{gsM6} \quad (5)$$

Both transistors M3 and M6 operate in the saturation region, hence:

$$Idr \times R4 + \sqrt{\frac{2Idr}{K_{M3}}} = \sqrt{\frac{2 \times Iload}{K_{M6}}} \quad (6)$$

Solving equation (6) gives:

$$\sqrt{Idr} = \frac{\sqrt{\frac{2}{K_{M3}} + 4 \times R4 \times \sqrt{\frac{2 \times Iload}{K_{M6}}}} - \sqrt{\frac{2}{K_{M3}}}}{2R4} \quad (7)$$

Comparing equations (3) and (4) with equation (7), it can be seen that pole P2 changes with the square root of the load current (Iload) and has the same dependence on the square root of load current (Iload) as zero Z1. Therefore, the compensation circuit and method of the present invention substantially mitigates over-compensation during heavy load conditions and under-compensation during light load conditions. This results in a compensation method and circuit that has excellent stability. During design, proper component values are chosen to allow zero Z1 to be slightly lower in frequency than pole P2. As the load current increases, Idr also increases pushing pole P2 farther and farther out in frequency. Simultaneously, zero Z1 is pushed farther and farther out in frequency due to the same dependence on the square root of load current (ILoad).

Using the compensation method of the present invention, it is not necessary to exert strict limitations on the capacitance and ESR of the output capacitor any longer to achieve a stable LDO (low drop-out) regulator. In a typical design, a stand-by LDO regulator with an output=3.3V and drop-out voltage=0.6V@170 mA can stay stable under the following extreme conditions:

i) Capacitance of the output capacitor is greater than 0.1 uF, and ii) ESR of the output capacitor is less than 30 ohm.

The compensation circuit and method of the present invention has certain advantages over the prior art. An LDO regulator using the present compensation method has good stability even with a very small output capacitor, and does not require an output capacitor with small ESR. Thus, there is almost no limitation on the capacitor type that can be used. The circuit and method of the present invention decreases quiescent current (Iq) of the regulator significantly, especially under heavy load conditions. The compensated LDO regulator of the present invention is ideally suited for use in automotive applications, but it is apparent to those skilled in the art that the regulator can be used in a wide range of other applications as well.

For an example design using a particular semiconductor process, the following values are taken for the components referred to in FIG. 2:

R1=1.2 Mohm,
R3=250 kohm,
M1=100 u/3μ,
M6=30 mm/2.6μ,)
M8=5 u/2μ
Cc=9 pF
R2=665 kohm,
R4=5.5 kohm,
M2=150 u/3μ,
M7=3×"8.4μ/2.6μ" (in series
M9=5 u/2μ
Ilow=4 μA.
Rc=10 kohm,
M3=60μ/2.6μ,
Rp=250 kohm, Transistors M1/M2/M8/M9 are the same type of NMOS transistor with uCox/2=34 uA/$V^2$. Transistors M3/M6/M7 are the same type of PMOS transistor with $R_{on}$*Area=0.87 ohm@Vgs=5V The current source Ilow is included to provide better stability during no-load or low load operating conditions.

The following results shown in FIGS. 3-9 are from a simulation using a specific semiconductor process model. Simulation results will be different using different component values and different models required for a specific application. It is appreciated by those skilled in the art that different component values and different semiconductor processes can be used in conjunction with the compensation method and circuit of the present invention, while still realizing the stable compensation benefits as described herein.

Figure 3:
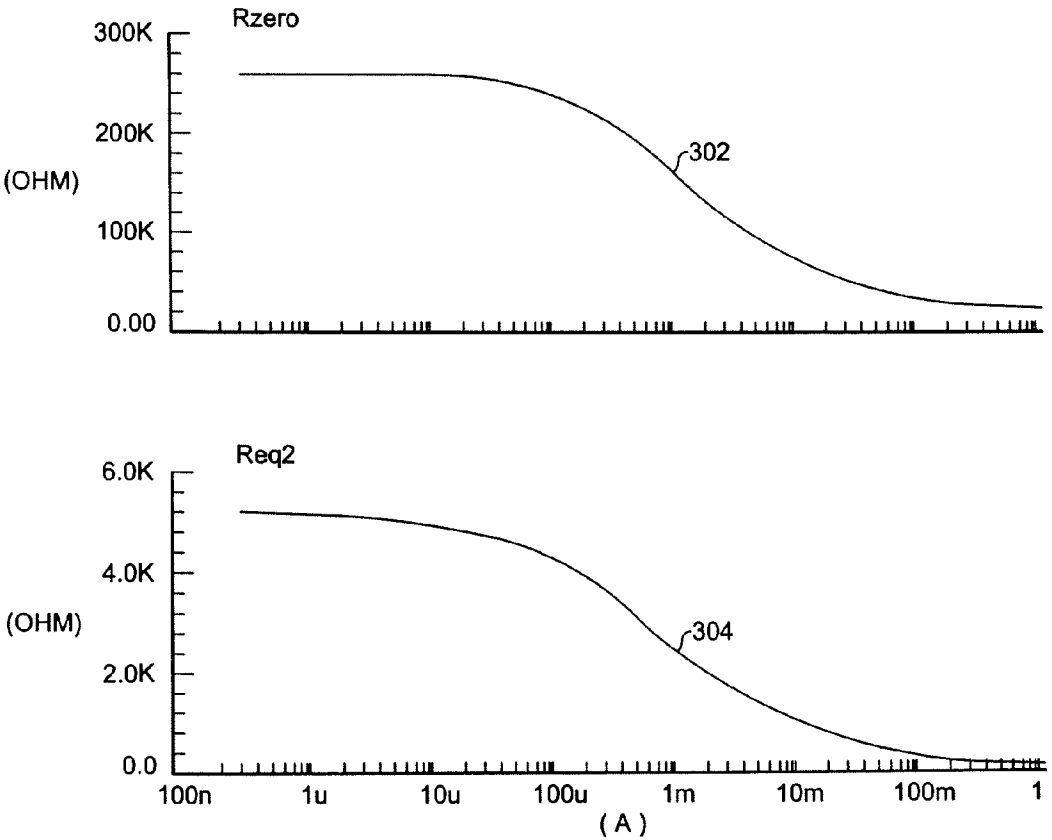
FIG. 3 is a plot of Req2 and Rzero with respect to load current of the compensated regulator of the present invention.
Figure 4:
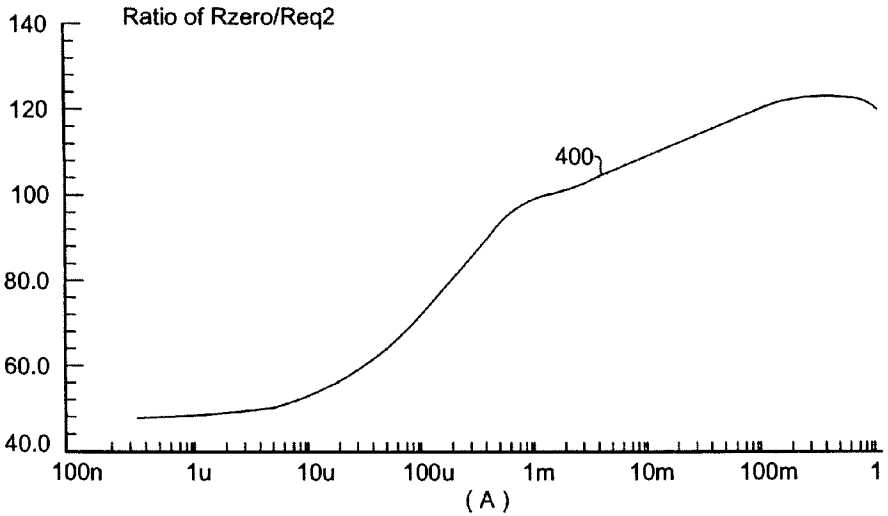
FIG. 4 is a plot of the ratio of Rzero to Req2 with respect to load current of the compensated regulator of the present invention.

Referring now to the plots of FIG. 3 and FIG. 4, both Rzero 302 and Req2 304 decrease with output load current, but Req2 decreases slightly faster as shown in the ratio plot 400 of FIG. 4.

Figure 5:
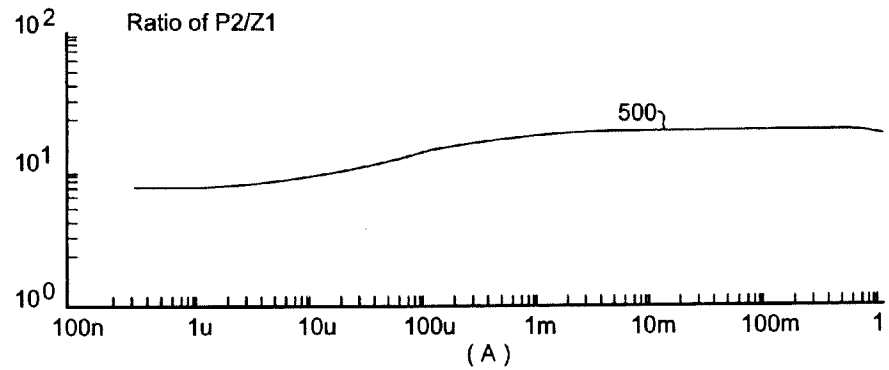
FIG. 5 is a plot of the ratio of P2 to Z1 with respect to load current of the compensated regulator of the present invention.

Based on simulation results, Ceq=58.5 pF, while Cc=9 pF, and so the ratio 500 of FIG. 5 shows that zero Z1 is always lower than pole P2, but relatively close to pole P2 throughout the entire range of the load current. The ratio 500 graph of FIG. 5 demonstrates the stability of the compensation method of the present invention, which makes designing an LDO regulator easier.

All of the following FIGS. 6-9 show the simulated performance of a 3.3V-standby LDO regulator with 0.6V dropout at 170 mA of load current utilizing the present invention. An output load pulse and transient output voltage spikes, as well as regulated output voltage are shown.

Figure 6:
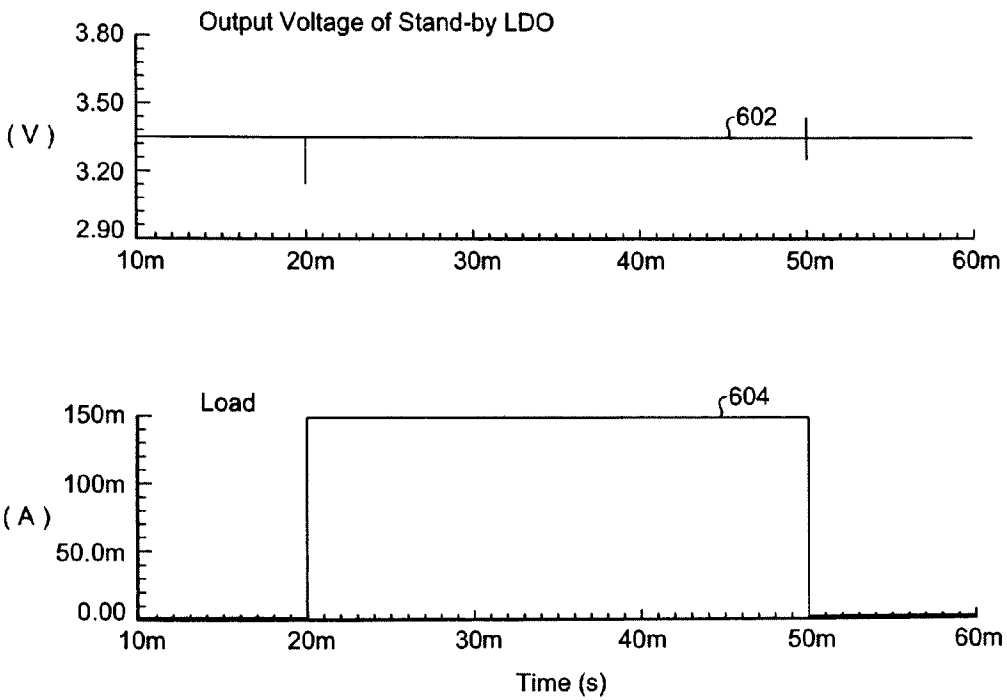
FIG. 6 is a plot of the regulated output voltage and load transients with the output capacitor=0.1 uF and ESR=0 ohm according to the present invention.

FIG. 6 shows the regulated output voltage 602 with the load transient spikes, and an output load pulse 604, with an output capacitor of 0.1 μF and an ESR of zero ohms, both with respect to time.

Figure 7:
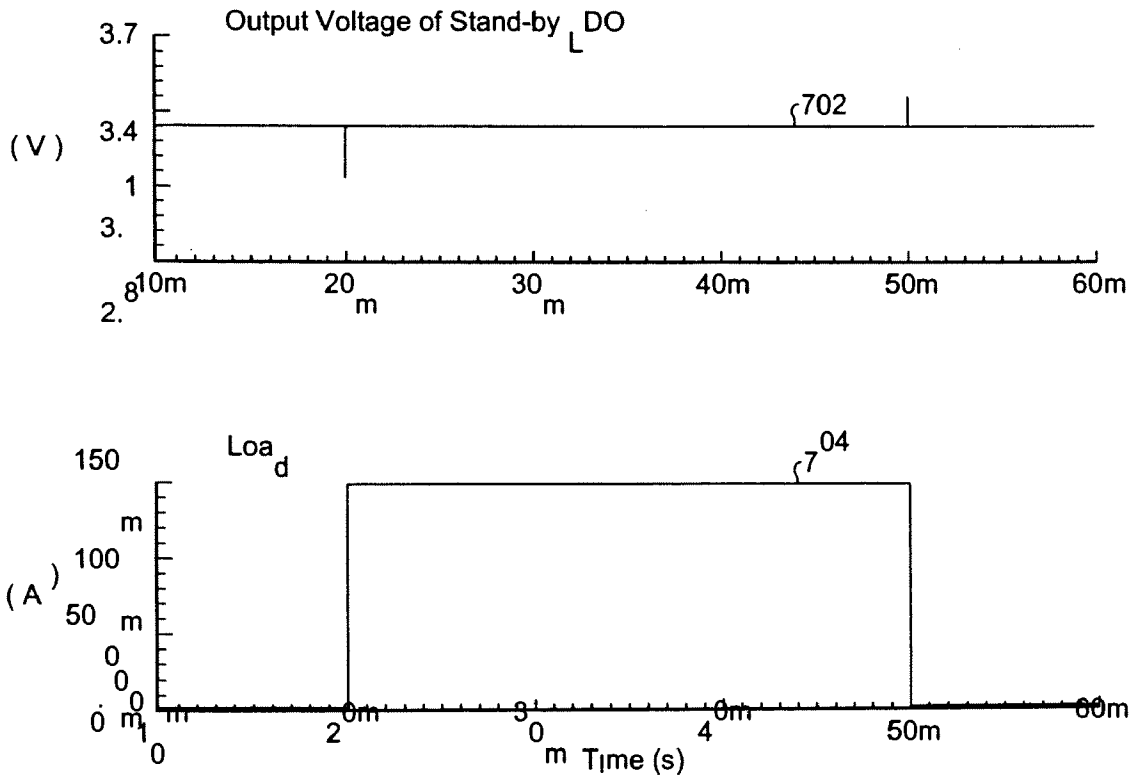
FIG. 7 is a plot of the regulated output voltage and load transients with the output cap=0.1 uF and ESR=30 ohm according to the present invention.

FIG. 7 shows the regulated output voltage 702 with the load transient spikes, and an output load pulse 704, with an output capacitor of 0.1 μF and an ESR of 30 ohms, both with respect to time.

Figure 8:
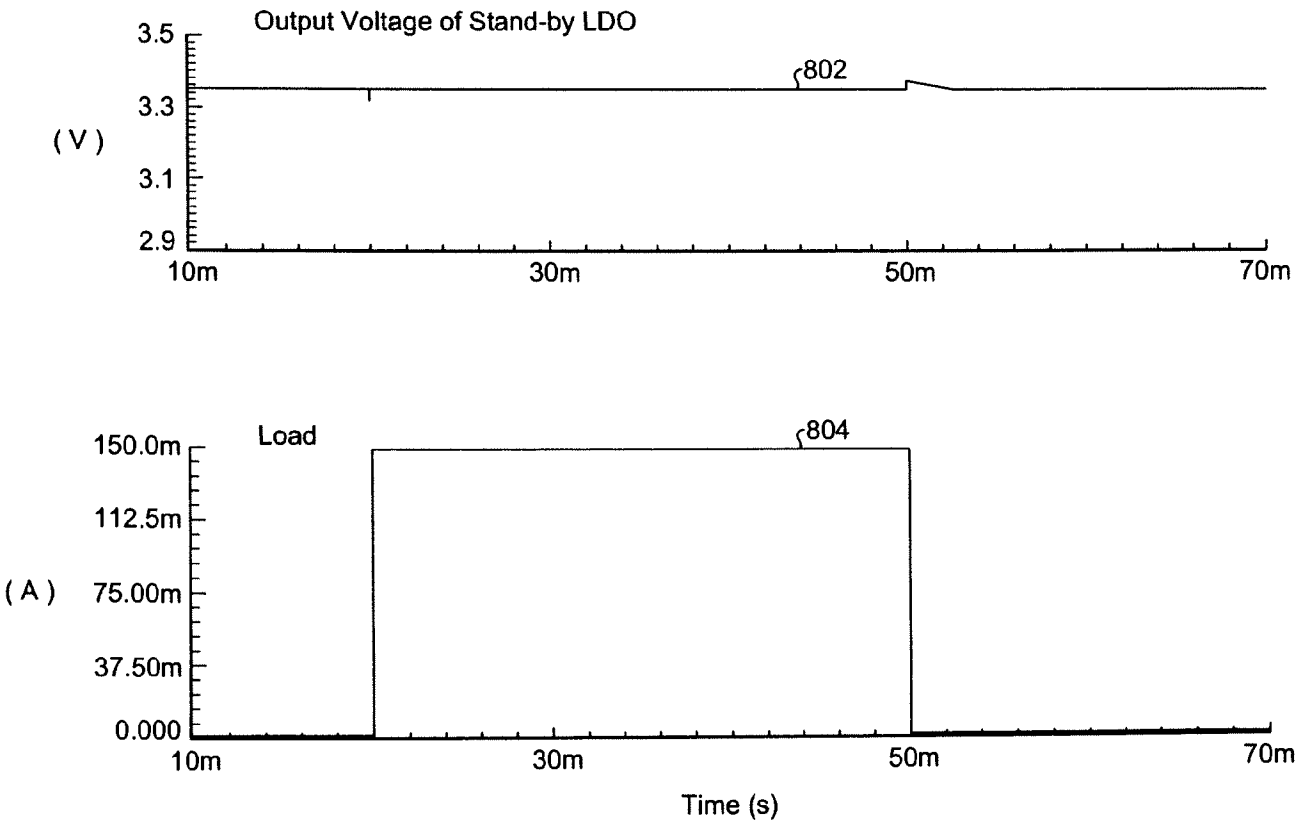
FIG. 8 is a plot of the regulated output voltage and load transients with the output cap=100 uF and ESR=0 ohm according to the present invention.

FIG. 8 shows the regulated output voltage 802 with the load transient spikes, and an output load pulse 804, with an output capacitor of 100 μF and an ESR of zero ohms, both with respect to time.

Figure 9:
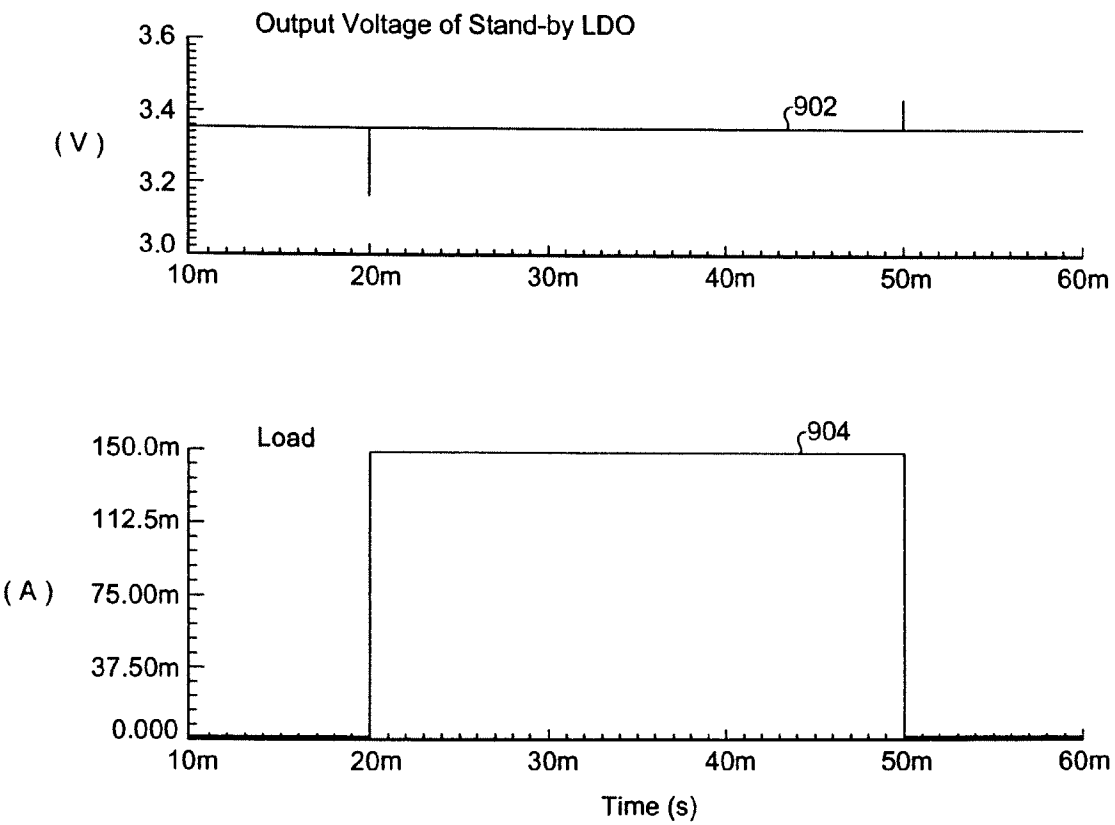
FIG. 9 is a plot of the regulated output voltage and load transients with the output cap=100 uF and ERS=30 ohm according to the present invention.

FIG. 9 shows the regulated output voltage 902 with the load transient spikes, and an output load pulse 904, with an output capacitor of 100 μF and an ESR of 30 ohms, both with respect to time.

In the regulator loop of the circuit of the present invention as shown in FIG. 2, there are a total of three poles and two zeros that are the main contribution to improved stability as before. However, zero Z1 is determined by a variable resistance as described above, times capacitance Cc. In the circuit of the present invention, zero Z1 varies with the load current, whereas in the prior art zero Z1 is fixed. In the circuit of the present invention zero Z1 and pole P2 remain close to each other in frequency for the entire range of load current range. Effectively, zero Z1 cancels pole P2 and so there are only two remaining poles P0 and P1, one remaining zero Z0. This, in turn, makes the loop stability design of the regulator easier.

While there have been described above the principles of the present invention in conjunction with specific memory architectures and methods of operation, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicant hereby reserves the right to formulate new claims to such features and/or combinations of such features during the prosecution of the present application or of any further application derived therefrom.

We claim:

1. A compensation method for an electronic circuit comprising:

providing a compensation block coupled to a node in the electronic circuit;

sensing a load current of the electronic circuit; and adjusting the impedance of the compensation block in response to the value of the load current, wherein the compensation block comprises a first resistor, a second resistor in series connection with the first resistor, a capacitor in series connection with the first and second resistors, a current mirror in parallel connection with the second resistor for receiving a sensed load current, and a buffer stage coupled between the first and second resistors, and the current mirror.

2. The compensation method of claim 1 wherein sensing the load current of the electron circuit comprises providing a current sensing transistor in parallel with an output current driving transistor.

3. An electronic circuit comprising:

a compensation block coupled to a node in the electronic circuit;

means for sensing a load current of the electronic circuit; and means for adjusting the impedance of the compensation block in response to the value of the load current, wherein the compensation block comprises a first resistor, a second resistor in series connection with the first resistor, a capacitor in series connection with the first and second resistors, a current mirror in parallel connection with the second resistor for receiving a sensed load current, and a buffer stage coupled between the first and second resistors, and the current mirror.

4. The electronic circuit of claim 3 wherein the means for sensing the load current of the electron circuit comprises a current sensing transistor in parallel with an output current driving transistor.

5. A compensated regulator comprising:

a transconductance stage having a positive input for receiving a reference voltage, a negative input, and an output;

an adjustable compensation block coupled between the output of the transconductance stage and ground;

a feedback circuit having a first node coupled to the output of the compensated regulator, a second node coupled to the negative input of the transconductance stage, and a third node coupled to ground; and a driver stage having an input coupled to the output of the transconductance stage, a current output coupled to the output of the compensated regulator, and a sense output coupled to the adjustable compensation block, wherein the compensation block comprises:

a first resistor;

a second resistor in series connection with the first resistor;

a capacitor in series connection with the first and second resistors;

a current mirror in parallel connection with the second resistor for receiving a sense current from the sense output, and for providing a variable resistance; and a buffer stage coupled between the first and second resistors, and the current mirror.

6. The compensated regulator of claim 5, wherein the feedback circuit comprises a first resistor coupled between the first node and the second node, and a second resistor coupled between the second node and the third node.

7. The compensated regulator of claim 5, wherein the driver stage comprises an output current driving transistor.

8. The compensated regulator of claim 7 further comprising a current sensing transistor in parallel with the output current driving transistor.

9. A compensated regulator comprising:

a compensation impedance that is variable with load current;

a plurality of poles and zeros in a compensation loop;

a first pole that moves in frequency with the value of the load current; and a first zero that moves in frequency with the value of the load current, wherein the movement in frequency of the first pole and first zero substantially tracks each other with respect to the value of the load current so that the first pole and the first zero are substantially canceled out over a range of load current values between about one microamp and one amp, and wherein the compensation impedance comprises a first resistor, a second resistor in series connection with the first resistor, a capacitor in series connection with the first and second resistors, a current mirror in parallel connection with the second resistor for receiving a sensed load current, and a buffer stage coupled between the first and second resistors, and the current mirror.

10. A compensated regulator comprising an LDO regulator having a compensation node coupled to a compensation block, wherein the compensation block comprises a first resistor, a second resistor in series connection with the first resistor, a capacitor in series connection with the first and second resistors, a current mirror in parallel connection with the second resistor for receiving a sensed load current, and a buffer stage coupled to the current mirror.

* * * * *